United States Patent [19]

Dreher et al.

[11] Patent Number: 4,674,701

[45] Date of Patent: Jun. 23, 1987

[54] WINDING APPARATUS

[75] Inventors: Anton Dreher; Josef Gramer, both of Horb, Fed. Rep. of Germany

[73] Assignee: Hans Deissenberger, Horb am Neckar, Fed. Rep. of Germany

[21] Appl. No.: 780,443

[22] Filed: Sep. 26, 1985

[30] Foreign Application Priority Data

Oct. 18, 1984 [DE] Fed. Rep. of Germany ..... 3438179

[51] Int. Cl.[4] ..... B65H 75/24

[52] U.S. Cl. ..... 242/110.2; 242/72 R; 242/115

[58] Field of Search ..... 242/110.2, 110.1, 110, 242/115, 116, 72, 72.1

[56] References Cited

U.S. PATENT DOCUMENTS

| | | | |
|---|---|---|---|
| 1,451,131 | 4/1923 | Weber | 242/110.2 X |
| 2,529,185 | 11/1950 | Proctor | 242/72.1 |
| 2,839,258 | 6/1958 | Jacobson | 242/110.2 |
| 2,866,606 | 12/1958 | Westfall et al. | 242/110.2 |
| 2,971,721 | 2/1961 | Jones | 242/110.2 |
| 3,275,261 | 9/1966 | Hanscom | 242/110.2 |

FOREIGN PATENT DOCUMENTS

| | | | |
|---|---|---|---|
| 2644084 | 4/1978 | Fed. Rep. of Germany | 242/110.2 |
| 2912806 | 10/1980 | Fed. Rep. of Germany | 242/110.2 |
| 2256665 | 7/1975 | France | 242/110.2 |

*Primary Examiner*—Stanley N. Gilreath

*Attorney, Agent, or Firm*—Bachman & LaPointe

[57] ABSTRACT

A winding apparatus is proposed enabling a substantially automatic winding on and removal of different winding material on to a two-part winding head. The winding head comprises a first swivellable side flange driven by a stepping motor. The second side flange can be axially displaced and on removal from the first side flange leads to the tapering of the free end of the winding core, so that winding material can be ejected by swivelling the first side flange.

11 Claims, 5 Drawing Figures

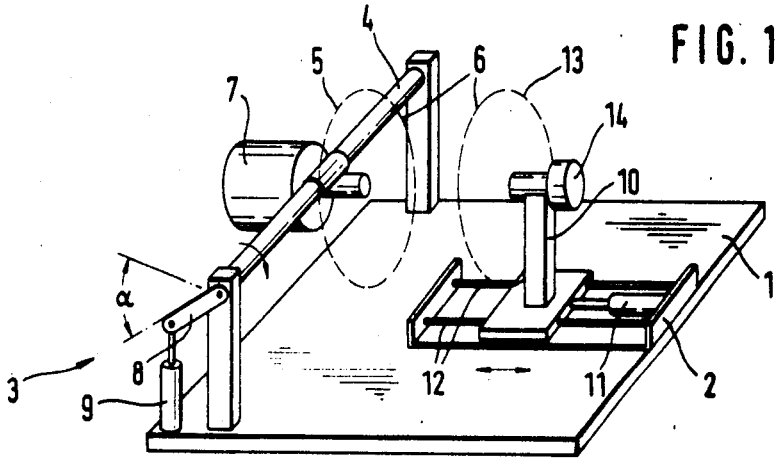
FIG. 1
FIG. 2
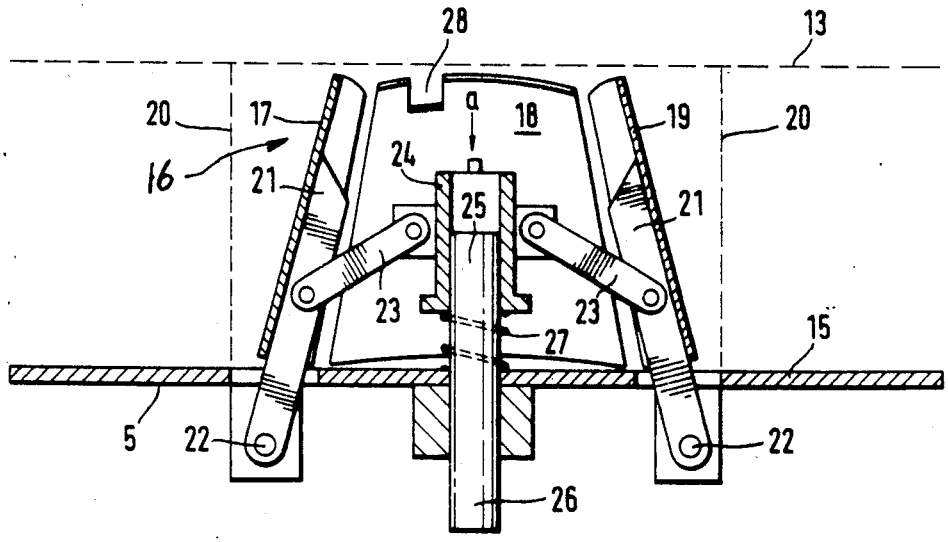

WINDING APPARATUS

BACKGROUND OF THE INVENTION

The invention relates to a winding apparatus including a winding head which has a winding core defined by two side flanges with a clamping device for the start of the winding material.

Known winding apparatuses use winding heads, to which the beginning of the winding material must be fixed by hand prior to the winding process. In the known winding heads, the fixing means are constituted by wedge-shaped cutouts on the winding core, into which is inserted the beginning of the winding material and is fixed there. The wound-up cable, hose or profile rings or coils, which have been wound by hand or with a motor drive then have to be manually removed . This manual work is time-consuming and monotonous.

The problem of the present invention is to provide a motor-driven winding apparatus enabling the processing of the winding material to be at least substantially mechanically performed.

SUMMARY OF THE INVENTION

This problem is solved in the case of a winding apparatus of the aforementioned type wherein on the first side flange is arranged a winding core comprising several individual segments and whose core diameter is variable and wherein the second side flange is removably fixed to the winding core. The winding head comprising a first and a second side flange is preferably mechanically moved together or apart. The winding head core comprising a plurality of swivellable or pivotable individual segments, which is fixed to the first side flange, can be tapered by means of a pneumatic or hydraulic drive following the removal of the second side flange and after the tying of the winding material. However, the winding head can also be constructed in such a way that it automatically tapers on removing the second side flange. The individual segments of the core are swivelled inwards, so that the wound-up winding material slides or can be stripped off. An automatic removal of the winding material can be ensured by a swivelling device, enabling the first side flange and consequently the winding core to be swivelled forwards, so that the winding material drops off. The clamping device which secures the start of the winding material during the winding process opens on removing the second side flange.

The clamping device is preferably constructed in such a way that a recess is provided at at least one of the individual segments in the vicinity of the ends thereof facing the second side flange, the start of the winding material projecting into the same. On the second side flange is provided at least one resilient clamping element, which with the second side flange engages the winding material in the recess and is pressed against the edge of the latter.

For the mounting and removal of the second side flange, it is axially displaceably fixed to a sliding or displacement unit, which has a supporting frame displaceable by means of a pneumatic cylinder parallel to the rotation axis of the winding head and on which is mounted in rotated manner the second side flange. For securing the winding head, the second side flange can be provided with an electromagnetic brake.

The swivellable or pivotable individual segments of the first side flange are arranged in such a way that on mounting the second side flange, the latter can be pressed outwards by means of joint plates until the winding core surface is parallel to the rotation axis. If the second side flange is removed at the end of the winding process, a spiral spring again presses the swivellable individual segments inwards. The swivel joints of the individual segments are located outside the winding core.

The drive shaft of the first side flange is rigidly connected with the lateral disk which bounds the winding core on one side and projects into the interior of said core. A slidingly mounted bush is provided on the drive shaft and is connected to the individual segments via joint plates. If the bush is pressed inwards to the said disk counter to spring tension, then as a result the individual segments are pressed outwards via the joint plates until the winding core surface is parallel to the drive shaft. The bush on the drive shaft is operated on mounting the second side flange by a further resiliently mounted bush of said second side flange.

The motor provided for the drive of the winding head is preferably a stepping motor, which permits an exact positioning of the recesses for receiving the start of the winding material. It is possible in this way to insert mechanically by means of a gripper arm the start of the winding material into the recess on the winding head. The second side flange is then mounted axially on the first side flange, e.g. by means of a pneumatic drive. In order that the clamping elements arranged on the second side flange and the recesses of the first side flange always coincide, the second side flange is held by means of a brake in the corresponding position, so that it cannot turn during the axial displacements.

Advantageous further developments of the invention are shown hereinbelow.

BRIEF DESCRIPTION OF THE DRAWINGS

The invention is described in greater detail hereinafter relative to non-limitative embodiments and with reference to the attached drawings, wherein show:

FIG. 1 is a perspective view of a winding apparatus with a two-part winding head comprising a first and a second side flange.

FIG. 2 is a sectional view of first side flange in section.

DETAILED DESCRIPTION OF THE PREFERRED EMBODIMENTS

Figure 3:
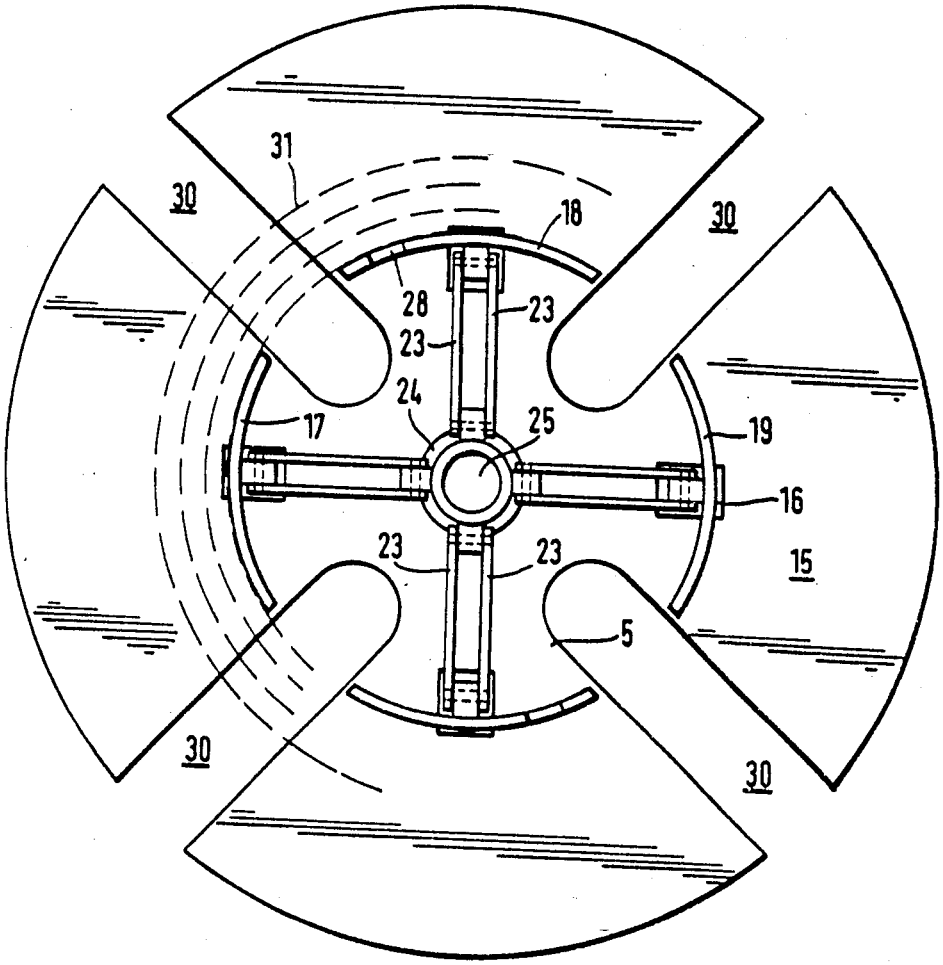
FIG. 3 is a detail of the plan view of the side flange shown in FIG. 2.

In the winding apparatus shown in FIG. 1, a displacement or sliding unit 2 and a swivelling device 3 are mounted on a base plate 1. A first side flange 5 of a winding head 6 is mounted on a swivel shaft 4 of swivelling device 3. The first side flange 5 is driven by a stepping motor 7. A swivel arm 8, operable by means of a cylinder 9, is fitted to swivel shaft 4. Swivel arm 8 can be swivelled upwards by cylinder 9 e.g. under an angle $\alpha=50°$, so that the first side flange 5 tilts forward. Winding material located on the not shown winding core of the first side flange can in this way be ejected therefrom.

The displacement unit 2 essentially comprises a supporting frame 10, which is displaceable parallel to the drive axis of the first side flange 5 by means of a cylinder 11. The drawing shows to guides bars 12 as the guidance members for the axial displacement of supporting frame 10. At the upper end of supporting frame 10 is rotatably mounted the second side flange 13 of winding head 6 and which can be arrested or secured in position by means of an electromagnetic brake 14.

The two side flanges 5 and 13 are only intimated in FIG. 1 here and are located in the open position, because the second side flange 13 is removed from the first side flange 5. By means of cylinder 11, the second side flange 13 can be moved relative to the first side flange 5.

FIG. 2 more particularly shows the construction of the first side flange 5, which essentially comprises a lateral disk 15 and a winding core 16, which is bounded on one side by disk 15. The second side flange 13 is shown by a dashed line in FIG. 2.

Winding core 16 of the first side flange 5 comprises a plurality of individual segments 17, 18, 19, which are here located in the inwardly swivelled position, as occurs with the second side flange removed. However, if the second side flange 13 is in the position shown by the dashed lines, then the individual segments 17 to 19 are brought into position 20 indicated by dashed lines.

Individual segments 17 to 19 are fixed to braces 21, which are swivellably mounted in swivel joints 22 on the side flange. Joint plates 23 are fixed to braces 21 spaced from the swivel joints 22 and the other ends thereof are fixed to an axially displaceable bush 24, which is located on an extension 25 of drive shaft 26, which extends into the interior of winding core 16. By means of a spiral spring 27, bush 24 is resiliently supported relative to disk 15.

On mounting the second side flange 13, a resilient element fixed to the same presses on bush 24 in arrow direction a, so that individual segments 17 to 19 are simultaneously swivelled outwards into the position shown by dashed lines 20.

In the embodiment shown in FIG. 2, the individual segment 18 has a recess 28, into which can be inserted the start of the winding material prior to the winding process. After the start of the winding material has been inserted in recess 28, the complete second side flange 13 can be mounted and clamping elements 32, 33 as shown in FIGS. 4 and 4*a* engaged for fixing the start of the winding material, as will be seen hereinbelow.

The plan view of FIG. 3 shows side flange 5 with winding core 16, with the individual segments 17 to 19 in the position 20. For the insertion of the start 29 of the winding material, the complete winding head 6 and consequently also the first side flange 5 can be brought into a clearly defined position by means of stepping motor 7, so that recess 28 is always arranged in the sme position for the insertion process. As a result of this measure, the insertion of the start 29 of the winding material can always take place automatically by means of the not shown insertion device.

Disk 15 of side flange 5 has symmetrically arranged, radially positioned cutouts 30, which make it possible to tie the wound winding material 31 prior to the removal from winding core 16.

Figure 4:
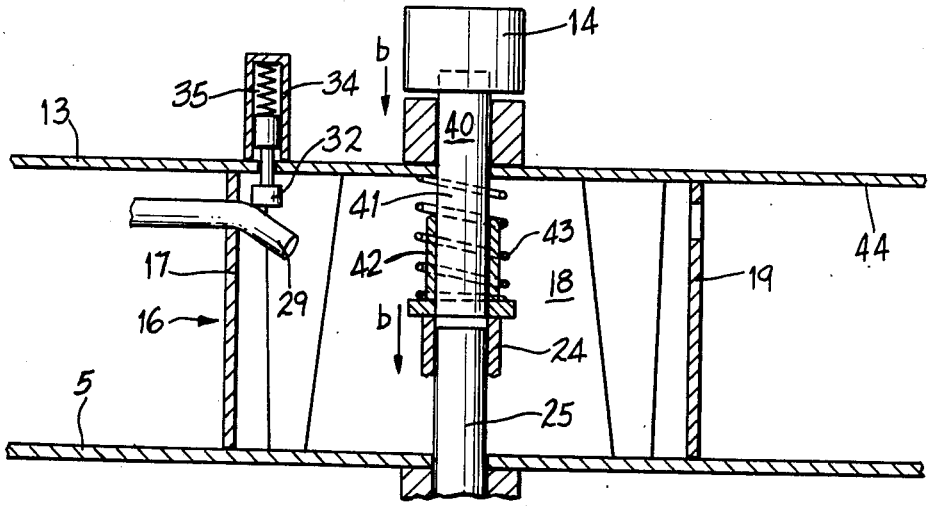
FIGS. 4 and 4*a* are views of the second side flange in conjunction with the first side flange in section and showing two different types of clamping elements.
Figure 4A:
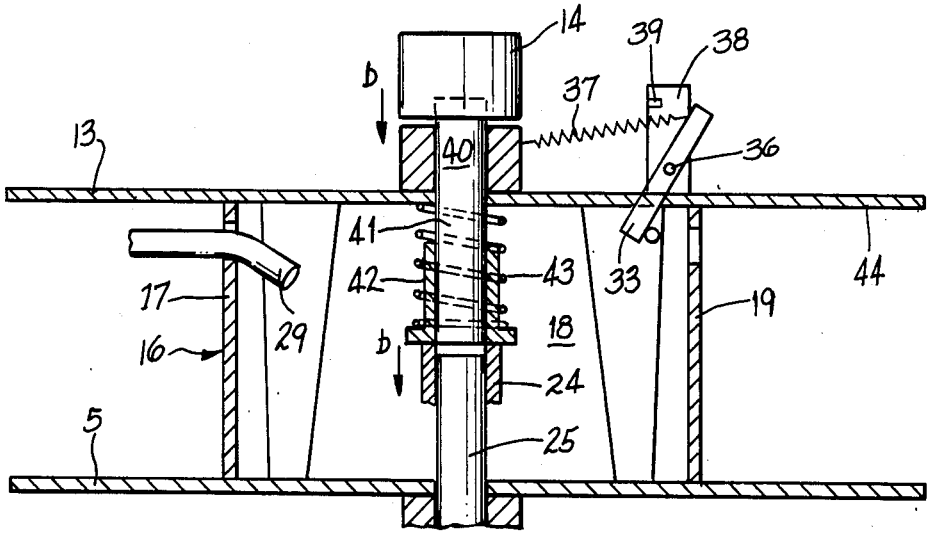

FIGS. 4 and 4*a* show the construction of the second side flange 13, which has clamping elements 32, 33 for fixing the start 29 of the winding material. FIGS. 4 and 4*a* show two different types of clamping elements 32, 33, with FIG. 4 showing clamping element 32 and FIG. 4*a* showing clamping element 33. Clamping element 32 is pressed downwards in the direction of the arrow b by a compression spring 34. The chamber 35, in which are arranged part of clamping element 32 and compression spring 34, preferably has a circular cross-section. The other clamping element 33 is swivellably mounted about a spindle 36 and is moved in the direction of the arrow b by a tension spring 37. The mounting support 38 for clamping element 33 has a stop 39, which limits the mobility of clamping element 33.

The second side flange 13 has a spindle 40, which is connected to an electromagnetic brake 14. The extension 41 of spindle 40 projecting into the winding core 16 of the winding head also acts as a guidance member for a resiliently positioned bush 42. By means of a relatively strong spiral spring 43, bush 42 is forced away in the direction of the arrow with respect to the disk 44 of the second side flange 13 acting as a lateral boundary. On mounting the second side flange 13 on the first side flange 5 in accordance with arrow direction b, initially bush 24 is forced downwards from bush 42 in the direction of arrow b, because spiral spring 27 has a smaller spring tension than spiral spring 43. Thus, the individual segments 17 to 19 are initially brought into the position shown in FIG. 4, before the second side flange 13 engages on winding core 16. Bush 42 is only then pressed upwards counter to the spring tension of spiral spring 43 when bush 24 has reached its bottom end position.

Thus, when the start of the winding material 29 will be inserted in recess 28, the segments 17–19 are in the vertical position 20 and at that time side flange 13 is not yet in the position shown in FIG. 4. Then side flange 13 is pushed into the position shown in FIG. 4, whereby clamping means 32 clamps the start of the winding material 29. Only cylinder 11 (FIG. 1) holds flange 13 in this clamping position, whereby the force of spring 43 pushes down the bush 24 of the side flange 5 against the force of spring 27.

The drawings show an embodiment, which can be modified in such a way that the bush 24 is operable in a completely independent manner from the removal of the second side flange 13 by means of a special drive. This drive can be a pneumatic cylinder, which axially displaces bush 24. This pneumatic drive can also act on shaft 26, which can be rigidly connected to bush 24. In this case, the shaft 26 must be axially displaceably passed through the side flange 15, so that the drive for the winding process would act on the flange represented in hatched form in FIG. 2. Such a construction with a separate drive for bush 24 would have the advantages that the already wound winding material would still be firmly placed on the winding core when second side flange 13 was removed and could be tied there prior to ejection. During the tying process, it would be ensured that there was no change to the ring shape of the winding material. Only after completion of tying, would the bush 24 be moved enabling the tapering of the winding core diameter.

What is claimed is:

1. A winding apparatus for winding material thereon which comprises a winding head including two facing side flanges, an annular winding core affixed to a first of said side flanges, wherein said core includes several individual segments whose diameter can be varied, and a means for removably affixing a second of said side flanges to the winding core, a clamping device associated with at least one of said flanges for fixing the winding material at the start thereof, and a swivel mechanism for tilting the first side flange from a first winding position to an eject position to eject winding material from the winding core.

2. A winding apparatus according to claim 1 including means for mounting the individual segments for joint pivotability.

3. A winding apparatus according to claim 1 wherein said individual segments have free ends facing the second side flange.

4. A winding apparatus according to claim 3 including means for moving the second side flange away from the first side flange, wherein the clamping device opens through the movement of the second side flange and wherein the winding core diameter tapers in the direction of the free ends of the individual segments.

5. A winding apparatus according to claim 3 wherein the clamping device includes a recess on at least one of the individual segments in the vicinity of its ends facing the second side flange and into which projects the start of the winding material and wherein on the second side flange is arranged at least one resilient clamping element which, with the second flange, secures the start of the winding material in the recess.

6. A winding apparatus according to claim 1 wherein swivel mechanism includes a swivel shaft mounting said first side flange and a swivel arm connected thereto wherein the swivel shaft can be swivelled by an angle $\alpha$ of approximately 50° via said swivel arm, and including a drive cylinder connected to said swivel arm.

7. A winding apparatus according to claim 1 wherein the second side flange includes a spindle with an electromagnetic brake.

8. A winding apparatus according to claim 1 including an axially displaceable bush connecting the individual segments by means of joint plates at a distance from their swivel joints, said bush being located on the extension of the drive shaft of the first side flange positioned within the winding core and, wherein a spring member or pneumatic cylinder presses the bush into position in which the free ends of the individual segments are swivelled inwards.

9. A winding apparatus according to claim 8 including a spindle of the second side flange extending into the interior of the winding core, a bush slidingly mounted on the second side flange, a spring member strongly pretensioning the bush in the direction of the first side flange, while the bush of the first side flange is forced back and consequently the individual segments are pressed outwards into a position parallel to the rotation axis.

10. A winding apparatus according to claim 9 wherein the spring member acting on the bush of the second side flange is stronger than the spring member acting on the bush of the first side flange.

11. A winding apparatus according to claim 1 including a stepping motor for driving the first side flange, which permits a positioned stoppage of the winding head.

* * * * *